United States Patent [19]

Takabayashi

[11] 4,103,583

[45] Aug. 1, 1978

[54] ELECTRIC GUITAR

[75] Inventor: Yojiro Takabayashi, Hamamatsu, Japan

[73] Assignee: Nippon Gakki Seizo Kabushiki Kaisha, Japan

[21] Appl. No.: 706,153

[22] Filed: Jul. 19, 1976

[30] Foreign Application Priority Data

Jul. 18, 1975 [JP] Japan ..... 50/99072[U]
Jan. 10, 1976 [JP] Japan ..... 51/1703[U]

[51] Int. Cl.[2] ..... G10D 1/08
[52] U.S. Cl. ..... 84/291; 84/293
[58] Field of Search ..... 84/1.16, 267, 290, 291, 84/292, 293; 144/309 AA

[56] References Cited

U.S. PATENT DOCUMENTS

| | | | |
|---|---|---|---|
| 600,507 | 3/1898 | Bremerman | 84/293 |
| 3,072,007 | 1/1963 | Burke | 84/267 |
| 3,435,721 | 4/1969 | Dopera | 84/292 X |
| 3,641,862 | 2/1972 | Rendell | 84/291 |
| 3,805,663 | 4/1974 | Okugawa | 84/293 |
| 3,915,049 | 10/1975 | Bean | 84/293 X |

*Primary Examiner*—Lawrence R. Franklin
*Attorney, Agent, or Firm*—Ostrolenk, Faber, Gerb & Soffen

[57] ABSTRACT

An improved electric guitar construction is disclosed. The guitar includes an elongated neck formed of a plurality of elongated pieces. One of the elongated pieces is formed of a harder material than the remaining elongated pieces. A body is coupled to one end of the neck. A top board covers at least part of the surface of the body as well as the elongated piece of the neck which is formed of a harder material than the remaining elongated pieces. The top board is made of a harder material than the body. A bridge element is attached to the top board.

15 Claims, 3 Drawing Figures

ELECTRIC GUITAR

BACKGROUND OF THE INVENTION

The present invention relates to an electric guitar, and more particularly relates to improved vibration transmissible construction of an electric guitar.

In conventional electric guitars, a neck having a head formed on one end thereof is coupled to a body at the end of the neck opposite to the head end. Strings are stretched between the head and a tail piece formed on the body. The strings run over a bridge element, also formed on the body. The neck and body are usually formed from a relatively soft wood such as mahogany, ash, katsura tree or nato, which are poor conductors of sonic vibration.

When a guitar is played, sonic vibrations developed by the strings are transmitted to the body via the bridge element and the tail piece then to the neck. However, due to the relatively poor transmission characteristics of the soft material, it is rare for the sonic vibrations to reach the entire body and neck of the guitar. As a result, the rich tones which would be generated if the entire body were to resonate are lacking. In view of this drawback, conventional electric guitars cannot produce sufficiently "fat" or "bite" sounds which are now in, particularly among young philharmonics.

BRIEF DESCRIPTION AND OBJECTS OF THE PRESENT INVENTION

An object of the present invention is to provide an electric guitar having rich transmissionability of sonic vibration.

Another object of the present invention is to provide an electric guitar having enhanced resonance of the body to the vibration of strings.

Still another object of the present invention is to provide an electric guitar capable of producing the desired "fat" or "bite" sounds.

In accordance with the present invention, a top board is provided covering at least the top surface of the body at least in the area wherein the bridge element and the tail piece are to be arranged and the top board is made of a material harder than that for the body.

In a preferred embodiment of the present invention, the top board is made of a relatively hard wooden material such as maple, ebony, birch or boxwood.

In another preferred embodiment of the present invention, the top board is made of a light metal such as aluminum.

In construction of the most conventional electric guitars, the neck is longitudinally coupled at one longitudinal end thereof to the body and the strings are stretched between the head and a tail piece arranged on the body running over the bridge element which is also mounted on the body.

With this construction, the acoustic characteristics of the electric guitar are believed to be more or less degraded due to the fact that the neck holding one end of all of the strings via the head and the body holding the opposite ends of the strings via the tail piece and the bridge element are separate bodies and are coupled to each other at the longitudinal end of the neck.

After a long term study on the relationship between the constructional feature and acoustic characteristics of electric guitars, it was confirmed by the inventor of the present invention that the acoustic characteristics of a guitar are greatly influenced by the mode of the coupling between the neck and the body. In other words, the coupling mode is a very important key factor for obtaining excellent acoustic characteristics. Upon vibration of the strings, the vibration is transmitted via the bridge element and tail piece to the body and further to the neck and the vibrations of these elements are collected by the pickup.

In the case of the conventional guitar in which the neck and the body are formed in separate elements and coupled to each other at one end of the neck, the vibration of the strings received by the body cannot be sufficiently transmitted to the neck, thereby degrading the sound quality of the electric guitar.

It is a further object of the present invention to provide an electric guitar provided with an ideal construction for coupling the neck with the body.

It is a further object of the present invention to provide an electric guitar which assures beautiful transmission of sonic vibration from the body to the neck.

In the other preferred embodiment of the present invention, the body is made up of a pair of body halves and the neck has a base coupled sideways to the body halves.

BRIEF DESCRIPTION OF THE DRAWINGS

Further features and advantages of the present invention will be made clearer from the following description, reference being made to the embodiments shown in the accompanying drawings, in which.

DETAILED DESCRIPTION OF THE PREFERRED EMBODIMENTS

Figure 1:
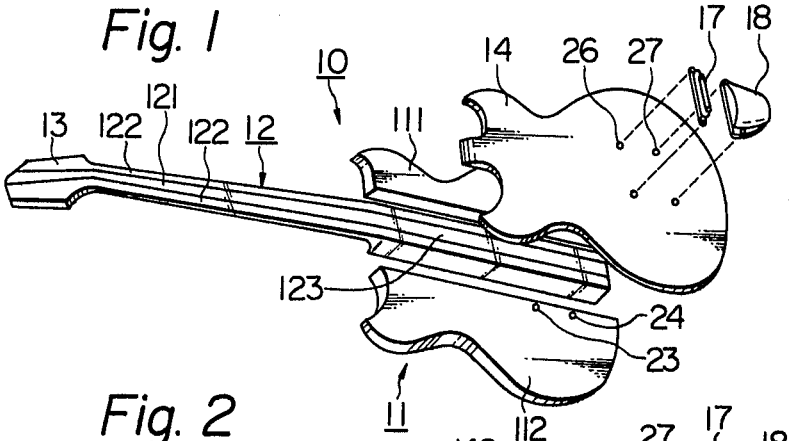
FIG. 1 is an exploded perspective view of an embodiment of the electric guitar in accordance with the present invention in a disassembled state and with certain elements omitted therefrom for purposes of simplicity.

Referring now to the drawings wherein like numerals indicate like elements, there is shown in FIG. 1 a first embodiment of a guitar constructed in accordance with the principles of the present invention and designated generally as 10. Guitar 10 includes a body 11, a neck 12 and a head 13. Neck 12 is coupled along its sides to the body 11 at the base 123 thereof. Head 13 is formed at the free end of neck 12. A top board 14 is affixed to the body 11 and the base 123 of the neck 12.

A plurality of strings (not shown) are to be stretched over the neck 12 and a portion of the body 11 in substantially parallel relationship relative to each other. More specifically, the strings are stretched between peg screws (not shown) provided on the head 13 and a tail piece 18 to be mounted on the body. The strings stretch over a bridge element 17 to be fixed to the body 11, via the top board 14, immediately adjacent to the tail piece 18 in order to bear the tension of the strings. Conventional electromagnetic pickups and electric controls (not shown) are to be provided, preferably upon top board 14. The body 11 is comprised of a pair of body halves 111 and 112, which are made of a relatively soft wooden material. The neck 12 comprises a center piece 121 and a pair of side pieces 122 sandwiching center piece 121 therebetween in a mutually bonded arrangement. All three pieces extend over the entire length of the neck 12 including the base 123 thereof. The center piece 121 is bonded to the side pieces 122 to form an elongated one-piece body over the entire length thereof.

The center piece 121 is formed from a relatively hard material whereas the side pieces 122 are formed from a relatively soft wood similar to the one used for the body halves 111 and 112.

The top board 14 covers, and is fixed with a suitable adhesive to substantially the entire, top surfaces of the base 123 of the neck 12 as well as the body halves 111 and 112. Top board 14 is a one-piece member of a relatively hard material preferably similar to the one used for the center piece 121 of the neck 12. The top board 14 is provided with threaded holes 26 and 27 for set screws (not shown) of the bridge element 17 and the tail piece 18. Pairs of threaded holes 23 and 24 are provided in the top surface of each body half 111 and 112 at positions corresponding to those of the holes 26 and 27 of the top board 14. Thus, by fixing the bridge element 17 and the tail piece 18 to the top board 14 by the set screws, the latter can be simultaneously fixed to the body 11 via the top board 14.

In an actual example of the electric guitar of this type, the total thickness of the body including the top board is 60mm., the maximum thickness of the top board is 15mm., the total width of the neck including the side pieces is 50mm. and the thickness of the center piece is 20mm.

Hard wood such as maple, ebony, birch or boxwood are preferably used for the center piece 121 of the neck 12 and for the top board 14. Light metals such as aluminum may also be used.

Soft wooden materials such as mahogany, ash, katsura tree or nato are used for the side piece 122 of the neck 12 and for the body 11.

In accordance with the present invention, especially with the present embodiment, the body halves 111 and 112 are interconnected by the top board 14 made up of the relatively hard material. The neck 12 is provided with a center piece 121, which extends over almost the entire length of the neck 12 and is made of the relatively hard material. The center piece 121 is in direct contact with the hard top board 14.

In general, transmission of vibration through a hard body is far better than that through a soft body. Thus, the sonic vibration generated by the strings is transmitted to the top board 14 via both the bridge element 17 and the tail piece 18 then to the entire body 11. This transmission is quite uniform since the top board 14 directly covers the entire top surface of the body 11. The vibration is further efficiently transmitted to the neck 12 due to the contact between the relatively hard bodies 14 and 121, the latter extending over almost the entire length of the neck 12. As a result of the foregoing structure, the electric guitar in accordance with the present invention can produce the desired "fat" or "bite" sounds with considerably long durations.

Further, provision of the hard interconnecting element, i.e. the top board 14, and the hard reinforcing element, i.e. the center piece 121, greatly enhances mechanical strength of the electric guitar against the vibration under tension of the strings.

Figure 2:
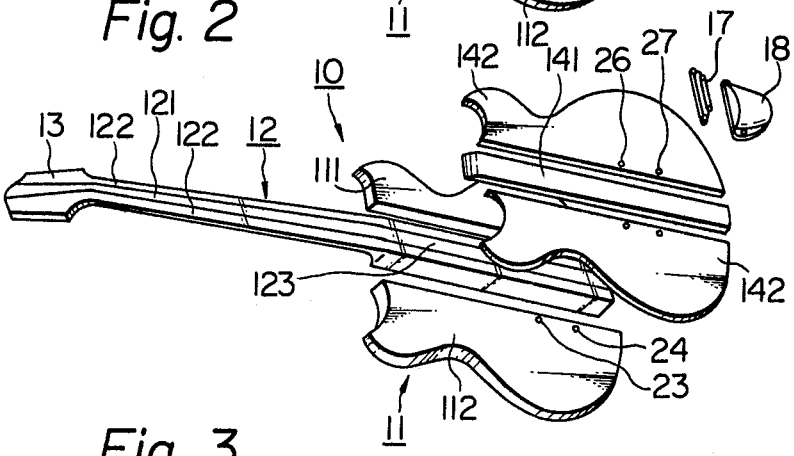
FIG. 2 is an exploded perspective view of another embodiment of the electric guitar in accordance with the present invention.

In the case of the embodiment shown in FIG. 1, the top board 14 is of a unitary one-piece construction which almost completely covers the top surfaces of the body 11 and the base 123 of the neck 12. The construction of the embodiment shown in FIG. 2 is almost the same as that of the one shown in FIG. 1 except that the top board 14 comprises a center strip 141 and a pair of side boards 142, which are made of a hard material such as the one used for the top board 14 in the embodiment of FIG. 1.

The center strip 141 covers almost the entire length of the base 123 of the neck 12 whereas the side boards 142 are substantially patterned after the top surfaces of the corresponding body halves 111 and 112, respectively. The side boards 142 are fixed to the body halves in tight, side-by-side contact with the center strip 141.

As for the acoustic effects, the electric guitar of this embodiment is almost the same as the electric guitar of the preceding embodiment. But, when compared with the top board 14 of the unitary construction of the foregoing embodiment, that of the present embodiment is made separate by three cut up elements 141 and 142, each being smaller than the top board 14 of the foregoing embodiment.

The top board 14 of the first embodiment is manufactured by cutting a single form out of a given square material board. The three elements 141 and 142 of the second embodiment are simpler in their patterns than the top board 14 of the first embodiment. Thus, the top board formed of the three elements of the embodiment of FIG. 2 can utilize the surface area of the square material board more effectively than the unitarilly constructed top board 14. Thus, for example, the center strip 141, being rectangular, can be cut from any fragmentary corner of the material board. As a result, the electric guitar constructed in accordance with this embodiment is less expensive to manufacture.

Figure 3:
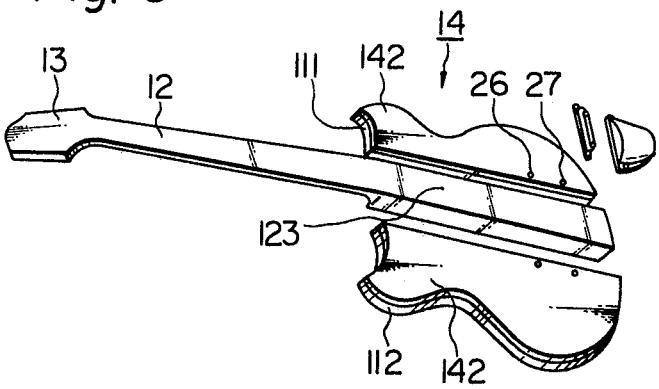
FIG. 3 is an exploded perspective view of still another embodiment of the electric guitar in accordance with the present invention.

The embodiment shown in FIG. 3 is a modification of the embodiment shown in FIG. 2. In this embodiment, the neck 12 is formed from a single, relatively soft wood and is of a longitudinally unitary construction. The top board 14 comprises a pair of side boards 142, which are patterned after the top surfaces of the associated body halves 111 and 112, respectively, with the center strip 141 in the embodiment of FIG. 2 being omitted. The pair of side boards 142, and their associated body halves 111 and 112, are secured to both side surfaces of the base 123 of the neck 12.

Although the electric guitar of this embodiment is somewhat inferior to those of the foregoing embodiments in the acoustic characteristics thereof, it still produces significantly better tone qualities than conventional electric guitars and is less expensive to produce.

In the case of the foregoing embodiments, the present invention is applied to those electric guitars which are provided with a neck of a longitudinally unitary construction and which extends through the body of the guitar. However, it will be clearly understood that the present invention is also applicable to the electric guitar in which a neck for carrying a head on one end thereof is joined longitudinally to a body at the other end thereof. In this case, the neck may either be of a transversely unitary construction or may be made up of three parallel elongated pieces coupled sideways to each other, the center piece being made of a harder material than that of the remaining two side pieces.

What is claimed is:

1. An electric guitar comprising:

an elongated neck formed of a plurality of elongated pieces, one of said elongated pieces being formed of a harder material than the remaining of said elongated pieces, said one of said elongated pieces extending throughout substantially the entire longitudinal length of said neck;

a body coupled to said neck, said neck extended a substantial distance into said body;

a top board covering at least a part of the surface of said body, said top board being made of a harder material than said body and contacting said one of said elongated pieces;

a bridge element attached to said top board in a portion of the area where said top board contacts said one of said elongated pieces.

2. An electric guitar as claimed in claim 1, wherein said body is made of a relatively soft wood such as mahogany, ash, katsura tree or nato.

3. An electric guitar as claimed in claim 1, wherein said top board is made of a relatively hard wood such as maple, ebony, birch or boxwood.

4. An electric guitar as claimed in claim 1, wherein said top board is made of a light metal such as aluminum.

5. An electric guitar as claimed in claim 1, wherein said neck has a top surface and two lateral surfaces and wherein said body comprises a first half coupled to one of said lateral surfaces and a second half coupled to the other of said lateral surfaces.

6. An electric guitar as claimed in claim 5, wherein each of said first and second body halves have a top surface which is coplanar with said top surface of said neck and wherein said top board covers almost the entire top surfaces of said body halves and a portion of said top surface of said neck.

7. An electric guitar as claimed in claim 6, wherein said top board is made up of a center strip covering said portion of said top surface of said neck and first and second side boards each covering almost the entire top surface of a different one of said body halves.

8. An electric guitar as claimed in claim 5, wherein said neck is made up of a center piece and a pair of lateral side pieces each extending over the entire length of said neck and being parallel to each other, said center piece being said one of said elongated pieces.

9. An electric guitar as claimed in claim 8, wherein each of said first and second body halves have a top surface which is coplanar with said top surface of said neck and wherein said top board covers almost the entire top surfaces of said body halves and a portion of said top surfaces of said neck.

10. An electric guitar as claimed in claim 9 in wherein said top board is of a unitary construction.

11. An electric guitar as claimed in claim 9, wherein said top board is made up of a center strip covering said portion of said top surface of said neck and first and second side boards each covering almost the entire top surface of a different one of said body halves.

12. An electric guitar as claimed in claim 8, wherein said center piece is made of a relatively hard wood such as maple, ebony, birch or boxwood.

13. An electric guitar as claimed in claim 8, wherein said center piece is made of a light metal such as aluminum.

14. An electric guitar as claimed in claim 8, wherein said side pieces are made of a relatively soft wood such as mahogany, ash, katsura tree or nato.

15. An electric guitar as claimed in claim 8, wherein said top board comprises a pair of side boards each of which covers almost the entire top surface of a different one of said body halves.

* * * * *